US005533246A

United States Patent [19]

Ashbrook

[11] Patent Number: 5,533,246

[45] **Date of Patent: * Jul. 9, 1996**

[54] BULLET PULLER

[75] Inventor: Clifford L. Ashbrook, Spicewood, Tex.

[73] Assignee: Quinetics Corporation

[ * ] Notice: The portion of the term of this patent subsequent to Oct. 27, 2012, has been disclaimed.

[21] Appl. No.: 246,810

[22] Filed: May 20, 1994

Related U.S. Application Data

[63] Continuation-in-part of Ser. No. 967,214, Oct. 27, 1992, Pat. No. 5,333,367.

[51] Int. Cl.[6] ..... B25B 27/14

[52] U.S. Cl. ..... 29/275

[58] Field of Search ..... 29/243, 275, 276, 29/254, 255, 282; 86/49; 81/19, 20; 254/26 R

[56] References Cited

U.S. PATENT DOCUMENTS 3,253,329 5/1966 Lehn .
3,646,661 3/1972 Ashbrook .
5,062,324 11/1991 Saviano .
5,333,367 8/1994 Ashbrook .

*Primary Examiner*—Robert C. Watson
*Attorney, Agent, or Firm*—Donald R. Comuzzi; Christopher L. Makay

[57] ABSTRACT

An inertial bullet puller includes a rigid tough transparent plastics material carrier tube having an opening at its upper end adapted to receive a cartridge and a head portion at its lower end adapted to be struck against a hard surface. The carrier tube is affixed to the end of a handle in a manner similar to the construction of a hammer. However, the carrier tube is not completely perpendicular to the handle, but instead, resides at an angle to the handle. At the upper end of the carrier tube is disposed an annular segmented cartridge support. A cap at the upper end of the carrier tube having a tapered inner end provides a cam surface for positively moving the annular segmented cartridge support radially inwardly and holding it in position. When a cartridge is inserted through the annular segmented cartridge support into the opening at the upper end of the tube, the cartridge support expands to pass the larger diameter portions of the cartridge, and then as the cap is tightened, the cartridge support contracts into the cannelure. In use the lower end of the tube is struck once or twice against a hard surface until the bullet is observed to pull free of the cartridge case.

9 Claims, 2 Drawing Sheets

BULLET PULLER

CROSS-REFERENCE TO RELATED APPLICATIONS

This application is a continuation-in-part of allowed application Ser. No. 07/967,214, filed Oct. 27, 1992, now U.S. Pat. No. 5,333,367.

BACKGROUND OF THE INVENTION

1. Field of the Invention

The present invention relates to inertial bullet pullers which are devices utilized to remove the bullet from the case of cartridge type round of ammunition. Inertial bullet pullers operate first by imparting a rapid motion to the cartridge and then bringing the case thereof to a quick stop. When the case slows down it tries to slow down the bullet too, thereby imposing tension on the connection between the bullet and case. If the tension force is great enough the connection parts, which is the desired result. The tension force is proportional to the time rate of change in the momentum of the bullet and for any given bullet mass is proportional to the time rate of change in bullet velocity. The latter depends on the initial velocity of the bullet and upon the length of time required to stop it, which in turn depends on the speed of propagation of the elastic shock wave through the material carrying the cartridge case.

2. Discussion of the Related Art

Prior art inertial bullet pullers include a rigid cartridge carrier in the form of a transparent, plastic material tube having an opening at one end adapted to receive a cartridge and provided at its other end with a head portion adapted to be struck against a hard surface. A cartridge support is provided at one end of the carrier tube for engaging the cannelure or other portion of the cartridge case. The head end of the carrier tube extends beyond the nose of the bullet and is closed with its interior being tapered at the lower end.

In use, a cartridge is placed in the carrier tube and supported therein by the cartridge support which engages the cannelure. A securing cap is provided for holding the cartridge support to the end of the carrier. The head portion at the end of the carrier tube is repeatedly struck against a hard surface such as the top of a table until the bullet pulls free of the case. To facilitate accelerating the carrier to a high velocity and striking it against a fixed hard surface the carrier is provided with a handle extending transversely from the carrier tube. The resulting carrier and handle combination has the overall shape of a hammer.

Prior art bullet pullers employ cartridge supports in the form of an open-sided washer which extends from the top of the cartridge carrier to underneath the upper side of the cannelure when the puller is in use. A snug-fitting polyethylene cap is slipped over the upper end of the carrier and frictionally engages the carrier tube and holds the washer and cartridge in place. Such a cartridge support is the source of some difficulty because of a plurality of support washers having differing inner diameters must be employed in order to accommodate cartridges having different diameter cannelures. Also, after each use it is necessary to pull the tight-fitting cap off the end of the carrier.

Another form of cartridge support employed by prior art bullet pullers consists of a U-shaped plate which has a variable width between its tines in order to adapt it to cannelures of different diameters. However, such a cartridge support has so little area of engagement with the cannelure that it readily shears if the carrier is struck too hard.

An improvement over the above inertial bullet pullers is disclosed in my U.S. Pat. No. 3,646,661, the disclosure of which is herein incorporated by reference. According to my prior inertial; bullet puller, an annular segmented support is provided at the upper end of the carrier of the bullet puller which is extendable into and retractable from the cannelure of a cartridge placed therein. Additionally, the annular segmented support is configured to fit a wide range of cartridges having cannelures of different diameters. The annular segmented support comprises a plurality of arcuate shape members or segments adapted to be annularly disposed at the upper end of a carrier. A garter spring extends around the segments providing a resilient force for urging the segments radially inwardly to an extent limited either by engagement with a cartridge or by the otherwise spaced apart sides of the segments coming into engagement. A cam surface is provided for positively urging the segments radially inwardly and holding them positioned beneath the upper wall of the cartridge cannelure. The cam surface is carried by a cap that threadably engages the upper end of the carrier tube adjacent the cannelure.

Although the inertial bullet puller disclosed in my U.S. Pat. No. 3,646,661, improved over the existing prior art, it fails to operate as easily and efficiently as desired. Under ideal conditions, the head portion of the carrier tube must strike a hard surface squarely so that the carrier tube, and, thus, the cartridge from which the bullet is to be removed are perpendicular to the striking surface. That is, the force of the vector developed by striking the hard surface with the head portion of the carrier tube should be parallel to the axis of the cartridge from which the bullet is being extracted. If the carrier tube is not perpendicular to the surface being struck, the force vector cannot be parallel with the axis of the cartridge being disassembled which results in the bullet being extremely difficult to extract.

The inertial bullet puller in my U.S. Pat. No. 3,646,661, rarely works ideally and more often than not requires numerous raps against a hard surface—often as much as eight or more—to disengage the bullet from the case. That inertial bullet puller fails to operate easily and efficiently to remove bullets from their case because it was designed with a handle which is completely perpendicular to the carrier tube. The completely perpendicular configuration of the handle with respect to the carrier tube makes it difficult for a person using the inertial bullet puller to position his/her wrist in a manner which allows the head portion of the carrier to be struck squarely against a hard surface. Thus, because squarely striking the head portion is extremely difficult, my prior inertial bullet puller requires numerous blows to disengage the bullet from its case.

Furthermore, uncentered blows along the carrier tube head portion weakens the material used to make the carrier tube, thereby causing premature material failure. That is, when the head portion is not struck squarely, the force vector is not applied to the cartridge but rather is absorbed by the inertial bullet puller itself causing the carrier tube material to crystalize and prematurely break.

Another design deficiency not related to the handle position is that once the bullet disengages from the case, it is necessary to remove the securing cap before it may be retrieved from the carrier tube. Although the cartridge support was originally intended to part sufficiently far enough to allow the bullet to pass, it was discovered that the garter spring forces the segments together such that no matter how much the carrier tube is shaken or the securing cap rapped against a hard surface, the bullet does not pass and cannot be removed without first removing the securing cap.

The inertial bullet puller in my U.S. Pat. No. 3,646,661, is subject to premature breakage, is rather tedious to use, and requires a notable time investment when a significant number of pullets are pulled. Such performance characteristics are less than desirable to the ordinary shooting enthusiast. Accordingly, the present invention improves over the prior art and especially my U.S. Pat. No. 3,646,661, by solving the above problems.

SUMMARY OF THE INVENTION

The present invention improves over the related art including my U.S. Pat. No. 3,646,661 by employing a reconfigured handle and redesigned annular segmented support. The handle has been improved by altering its angle with respect to the carrier tube. Specifically, the handle is now angled 10 to 15 degrees in the preferred embodiment away from the head portion of the carrier tube when referenced to the horizontal plane created by the shaft portion of the carrier tube. In simpler terms, the handle is no longer perpendicular to the carrier tube but instead resides at a slight angle away from the completely horizontal plane defined by the carrier tube shaft portion. The purpose of the angled handle is to provide a user of the present invention with a better oriented and more relaxed wrist position which allows the head portion of the carrier tube to be consistently struck squarely against a hard surface. The angled handle improves the performance of the present invention by reducing the number of raps against the hard surface to an maximum average of two. Although an angled handle typically performs better than a completely straight handle, a completely straight handle may be used if easier manufacturing is a consideration.

Additionally, the present invention sets forth three new designs of the annular segmented support all of which improve over the original one disclosed in my U.S. Pat. No. 3,646,661. Each new design includes a plurality of segments connected together using a flexible O-ring. In a first embodiment, an O-ring is affixed to each segment of the plurality of segments and then completely severed at one location so that it no longer forms a continuous ring. The O-ring is affixed to each segment of the plurality of segments to keep them connected together, nevertheless, it is split to prevent the segments from being continuously forced radially inward.

In a second embodiment, two segments include shaved ends so that their ends protrude less than their centers. For use with rifle cartridges, the two segments are connected together with an O-ring, but for use with pistol cartridges, the O-ring is removed and the two segments are left unconnected. The segment ends are shaved so that uniform pressure in a radially inward direction will be applied to the segment centers by a securing cap as it is threadably attached to a carrier tube. A uniform pressure is necessary to ensure that the segments move squarely as they engage the casing cannelure. Square and uniform movement of the two segments as they engage the casing cannelure allows them to grasp the cannelure along the greatest surface area. If the ends of the segments were not reduced, the segments would engage the cannelure only at their ends, thereby, permitting many of the cartridges to pass through the segments after the carrier tube was struck against a hard surface.

In a third embodiment, an oversized O-ring is affixed to each segment of the plurality of segments, however, unlike the first embodiment, the O-ring remains unsevered. The O-ring remains unsevered because its larger size ensures that it does not force the plurality of segments radially inward. Since the O-ring produces no radially inward movement of the plurality of segments, only the tightening of the securing cap onto the carrier tube results in the plurality of segment moving radially inward to engage a cartridge. In fact, the oversized O-ring produces radially outward movement of the plurality of segments when the securing cap is loosened so that the bullet passes easily past the plurality of segments.

Accordingly, each of the above designs improve over my old design because they permit the bullet to be removed after separation from the casing without first having to unscrew the securing cap attached to the end of the carrier tube. The first embodiment permits passage of the bullet because the segment ends which remain unconnected as a result of the severed O-ring open sufficiently far when the securing cap is loosened to allow the bullet to pass when the carrier tube is shaken or the securing cap is rapped against a hard surface. Similarly, the second embodiment allows passage of the bullet because due to the use of only two segments there will always be an opening between the two segments, even in their most closed position, which is sufficiently large to permit the bullet to pass when the carrier tube is shaken or the securing cap is rapped against a hard surface. Finally, the third embodiment allows passage of the bullet because the oversized O-ring pulls the segments sufficiently far apart when the securing cap is loosened to permit the bullet to pass when the carrier tube is shaken or the securing cap is rapped against a hard surface.

It is, therefore, an object of the present invention to provide an inertial bullet puller which has an angled handle that reduces the number of times it must be struck against a hard surface before the bullet is separated from the casing.

It is another object of the present invention to provide an inertial bullet puller with an annular segmented support which allows a bullet separated from its casing to be removed from the carrier tube without first having to remove the securing cap.

Still other objects, features, and advantages of the present invention will become evident to those skilled in the art in light of the following.

DETAILED DESCRIPTION OF THE PREFERRED EMBODIMENT

Figure 1:
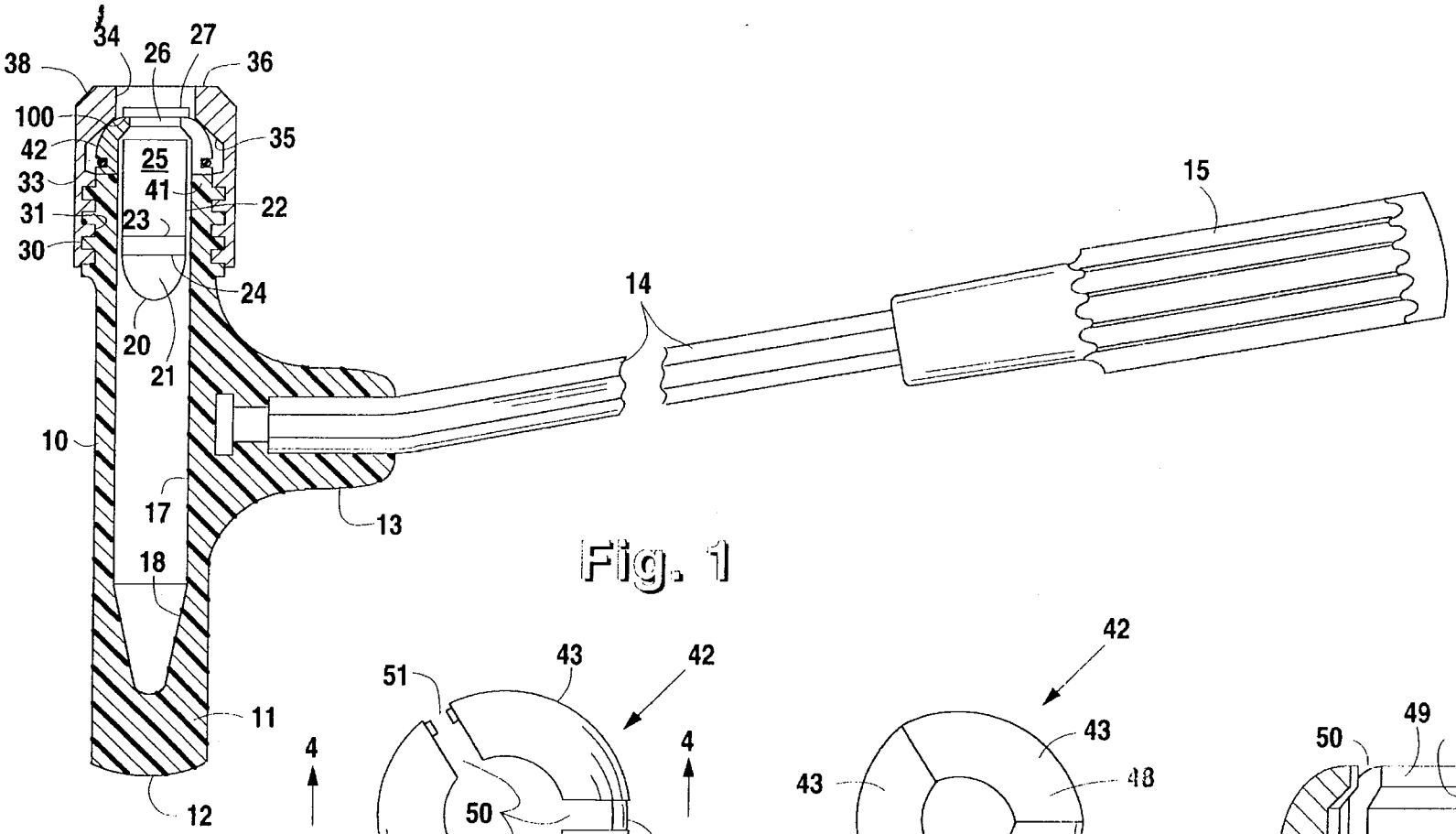
FIG. 1 is a side view partially in cross section showing the inertial bullet puller of the present invention.

Referring now to the drawings and especially FIG. 1, there is shown an inertial bullet puller including carrier tube 10. Carrier tube 10 is preferably constructed from a generally tubular plastics material member which has an opening at its upper end and a closed lower end 11 providing head portion 12 for striking against a hard surface.

Boss 13 on the side of carrier tube 10 provides a means for making a suitable connection to a, preferably, aluminum steel shaft 14. Fluted plastics material tube 15 forms a handgrip which is suitably secured to shaft 14. Boss 13, shaft 14, and handgrip 15 together form a handle for the carrier. In the preferred embodiment, shaft 14 is angled 10 to 15 degrees away from the horizontal plane defined by boss 13 in a direction away from closed lower end 11. The angle of the handle is provided because it permits a better oriented and more relaxed user wrist position which allows head portion 12 to be squarely struck against a hard surface on a consistent basis. Although an angled handle is disclosed, one skilled in the art will recognize that a completely horizontal handle may be substituted.

The diameter of inner surface 17 of carrier tube 10 is slightly larger than the largest cartridge expected to be used in the puller. Lower end 18 of inner surface 17 of carrier tube 10 is preferably tapered to provide a surface tangent to arcuate nose 20 of bullet 21 so as to slowly frictionally arrest the downward travel of bullet 21 when it is freed from its case 22.

Bullet 21 and case 22, which are crimped thereto at 23 and 24, form part of cartridge 25. Cannelure or annular groove 26 separates the main cylindrical tubular portion of case 22, which carries the powder charge, from head 27 of cartridge 25 which has a primer/detonator cap (not shown) disposed therein.

The upper end of carrier tube 10 is provided with an external helical screw thread 30 correlative to internal helical screw thread 31 of generally cylindrical cup-shaped screw cap 33. Cap 33 is preferably made of a plastics material similar to that of carrier tube 10. The upper end of cap 33 has a cylindrical opening or bore 34 which is of slightly larger diameter than cylindrical inner surface 17 of carrier tube 10. Cam surface 35 of end 36 of cap 33 is conical and flares toward the open end of cap 33. Preferably the outer periphery of the closed end of cap 33 is provided with bevel 38. The exterior surface of the sides of cap 33 is knurled for easy turning.

Annular segmented support 42 includes a plurality of segments (described herein with reference to FIGS. 2–6 and 8) and surmounts planar upper end 41 of carrier tube 10 in order to support cartridge 25 within carrier tube 10. Cap 33 provides means for positively moving the segments of annular segmented support 42 radially inwardly and holding them in position at planar upper end 41 of carrier tube 10. When cap 33 is screwed down cam surface 35 thereof moves the segments inwardly under upper side 100 of cannelure 26 so that they fit snugly against the smallest diameter portion of cannelure 26. Cap 33 retains the segments in that position on planar upper end 41 of carrier tube 10. The inertial bullet puller is then ready to use.

Figure 2:
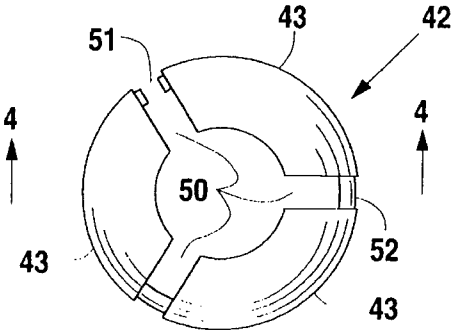
FIG. 2 is a top plan view showing the annular segmented support of the first embodiment of the present invention in an expanded position.
Figure 3:
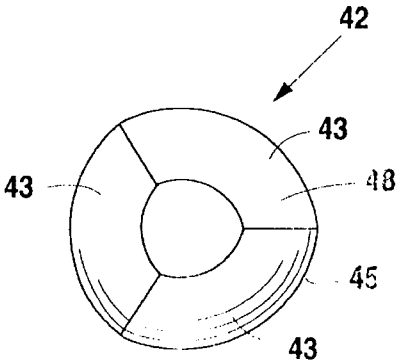
FIG. 3 is a top plan view showing the annular segmented support according to the first or third embodiment of the present invention in a fully contracted position.
Figure 4:
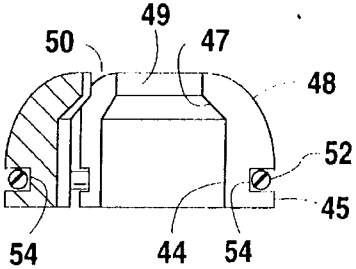
FIG. 4. is a vertical cross section of the annular segmented support according either the first or third embodiment of the present invention.

Referring to FIGS. 2–4, annular segmented support 42 according to the first embodiment of the present invention will be described. Annular segmented support 42 includes a plurality of segments 43. Any number of segments greater than one may be used but three is preferred. Each segment is an arcuate shell having inner and outer generally cylindrical surfaces 44, 45 and conical inner and near spherical curved outer upper surfaces 47, 48, and a cylindrical inner upper edge 49 (see FIG. 4). When disposed about the cannelure of a cartridge, as shown in FIG. 1, segments 43 are circumferentially spaced apart, as shown at 50 in FIGS. 2 and 4. Segments 43 are connected together using O-ring 52 which lies permanently affixed within grooves 54, one groove being in each of outer surfaces 45 of segments 43. O-ring 52 is provided only to serve as a connection between segments 43 and does not resiliently urge them inwardly. O-ring 52 produces no elastic force about segments 43 because, in the first embodiment, it is completely severed at space 51 shown in FIG. 2. No force must be maintained by O-ring 52 because the inward force necessary to urge segments 43 inwardly about a cartridge causing their edges 49 to snugly engage the smallest diameter part of the cannelure, as shown in FIG. 1, may be provided by tightening cap 33 until cam surface 35 of cap 33 engages outer upper surfaces 48 of segments 43. By removing the constant elastic force that would be produced if O-ring 52 were not severed, segments 43 will now allow a bullet separated from its casing to be removed from carrier tube 10 without first having to remove cap 33.

To connect segments 43 together, O-ring 52 is first placed about segments 43 and into each groove 54 of segments 43. Next, O-ring 52 is affixed within each groove 54 utilizing any suitable means such as staking. Staking involves crimping a section of each segment 43 such that the crimped section protrudes over each groove 54, thereby sealing O-ring 52 within each groove 54 to prevent its dislodging during use. Although the staking of O-ring 52 within each groove 54 of segments 43 is preferred, other means such as adhesives or a vulcanizing process may be employed. Finally, segments 43, which are now held together by O-ring 52, are expanded away from each other and O-ring 52 is severed at spaces 51 shown in FIG. 2, thereby, keeping segments 43 connected together but eliminating the elastic force of O-ring 52.

Figure 5:
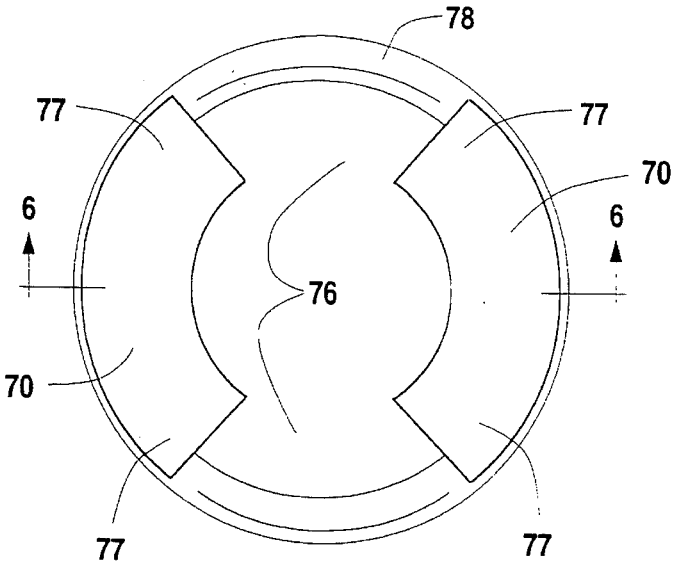
FIG. 5 is a plan view showing the annular segmented support according to the second embodiment of the present invention in an expanded position.
Figure 6:
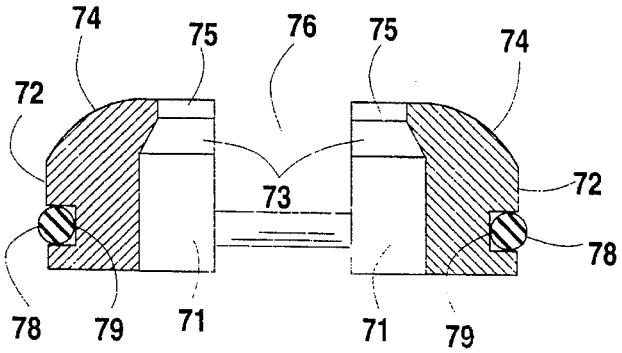
FIG. 6 is a cross sectional side view showing the annular segmented support according to the second embodiment of the present invention.

Referring to FIGS. 5 and 6, a second embodiment of annular segmented support 42 will be described. Annular segmented support 42 in this second embodiment includes two segments 70. Segments 70 are similar to segments 43 in that each has an arcuate shell having inner and outer generally cylindrical surfaces 71, 72 and conical inner and near spherical curved outer upper surfaces 73, 74, and a cylindrical inner upper edge 75 (see FIG. 6). Additionally, when disposed about the cannelure of a cartridge, as shown in FIG. 1, segments 70 are circumferentially spaced apart, as shown at 76 in FIG. 5 and 6. However, segments 70, unlike segments 43, have each of their ends 77 shaved to lessen their protrusion so that the centers of curved outer surfaces 74 protrude more than ends 77. Ends 77 are shaved to permit cam surface 35 of cap 33 to engage outer upper surfaces 74 of segments 70 directly in the center of segments 70. Thus, segments 70 are uniformly urged inwardly about a cartridge which causes their edges 75 to snugly engage the smallest diameter part of the cannelure along the largest surface area (see FIG. 1). If a rifle bullet is to separated from its casing, segments 70 are connected together using O-ring 78 which lies within grooves 79, one groove being in each of outer surfaces 72 of segments 70. If a pistol bullet is to be separated from its casing, then O-ring 78 is removed and segments 70 used completely unconnected. In the latter case, segments 70 are held in place by cap 33. Once the bullet has been separated from its casing, it can be removed from carrier tube 10 without the removal of cap 33 because after cap 33 is loosened, the opening between segments 70 will expand to a position sizable enough to permit even the largest caliber bullets to pass.

Figure 8:
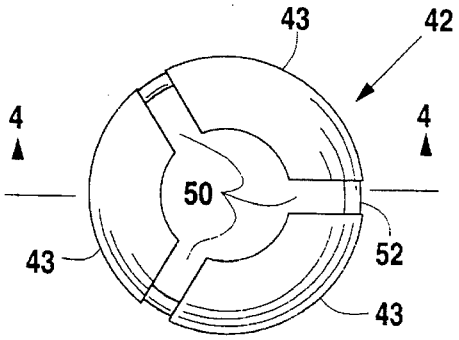
FIG. 8 is a top plan view showing the annular segmented support of the third embodiment of the present invention in an expanded position.

Referring to FIGS. 3,4, and 8, annular segmented support 42 according to the third embodiment of the present invention will be described. Annular segmented support 42 includes a plurality of segments 43. Any number of segments greater than one may be used but three is preferred. Each segment is an arcuate shell having inner and outer generally cylindrical surfaces 44, 45 and conical inner and near spherical curved outer upper surfaces 47, 48, and a cylindrical inner upper edge 49 (see FIG. 4). When disposed about the cannelure of a cartridge, as shown in FIG. 1, segments 43 are circumferentially spaced apart, as shown at 50 in FIGS. 4 and 8. Segments 43 are connected together using O-ring 52 which lies permanently affixed within grooves 54, one groove being in each of outer surfaces 45 of segments 43. O-ring 52 is provided only to serve as a connection between segments 43 and does not resiliently urge them inwardly. O-ring 52 produces no elastic force about segments 43 because, in the third embodiment, it is an oversized O-ring. That is, the diameter of O-ring 52 is greater than the outer diameter of annular segmented support 42 when segments 43 are directly adjacent. No force must be maintained by O-ring 52 because the inward force necessary to urge segments 43 inwardly about a cartridge causing their edges 49 to snugly engage the smallest diameter part of the cannelure, as shown in FIG. 1, may be provided by tightening cap 33 until cam surface 35 of cap 33 engages outer upper surfaces 48 of segments 43. By removing the constant elastic force that would be produced if O-ring 52 were not oversized, segments 43 will now allow a bullet separated from its casing to be removed from carrier tube 10 without first having to remove cap 33.

O-ring 52 is affixed within each groove 54 of segments 43 utilizing any suitable means such as staking. Staking involves crimping a section of each segment 43 such that the crimped section protrudes over each groove 54, thereby sealing O-ring 52 within each groove 54 to prevent its dislodging during use. Although the staking of O-ring 52 within each groove 54 of segments 43 is preferred, other means such as adhesives or a vulcanizing process may be employed.

In operation, the user grasps handgrip 15 and swings the puller to give high speed to carrier tube 10 and strikes head portion 12 at lower end 11 of carrier tube 10 against a hard surface, with carrier tube 10 moving with its axis perpendicular to the surface at the moment of impact. Carrier tube 10 comes to rest and may bounce off of the hard surface. In any event, the upper end of carrier tube 10 comes to rest slightly later than the lower end as determined by the speed of propagation of the elastic shock wave in the plastic of carrier tube 10. The speed of this shock wave will determine the increment of time during which the momentum of the cartridge case is changed from its initial downwardly directed maximum magnitude just prior to impact of the carrier with the hard surface to a zero or upwardly directed magnitude, and this in turn is proportional to the force exerted tending to pull the case and bullet apart. It may be considered that when the shock wave reaches annular segmented support 42 the upwardly moving end of carrier tube 10 pushes segments 43 upwardly relative to the cartridge, and the upper ends of segments 43 bearing against the upper side 100 of the cannelure pull the case from the bullet. The faster the wave moves the faster the upper end of carrier tube 10 moves relative to the cartridge case, or otherwise expressed, the more quickly the case is brought to rest. Thus, carrier tube 10 is preferably made of a material that transmits elastic waves at a high velocity but has a high impact strength so that it will not shatter. A plastics material sold under the trade name "Tennite" (Type 239 A22300M) is a suitable material, having an elastic wave velocity of 6,000 ft./sec. Suitable material may be described as being rigid and tough.

After striking carrier tube head portion 12 once or twice against a hand surface, bullet 21 falls free of cartridge case 22 into the lower part of carrier tube 10. Preferably carrier tube 10 is made of transparent material so that this result can be observed, although the rattling of the loose bullet in carrier tube 10 will make this known by sound and shock in any event.

Cap 33 is then loosened, backing it off sufficiently so that cam surface 35 is spaced axially from top surfaces 48 of segments 43, far enough so that they can expand to free the cartridge case and allow passage of the bullet. Carrier tube 10 is inverted and the cartridge case, bullet, and powder are shaken out of carrier tube 10, with segments 43 expanding under the force of the moving cartridge components. Segments 43 expand amply enough to allow even the largest caliber bullets to be removed without first completely detaching cap 33 because O-ring 52 is either oversized (see FIG. 8) or has been severed at one of the spaces 50 (see FIG. 2). More precisely, as the bullet strikes against inner cylindrical surfaces 44, segments 43 separate at space 51 (see FIG. 2) and allow the bullet to pass out cap opening 34 of cap 33. The bullet passes through segments 43 because O-ring 52 only connects segments 43 together and does not provide a restoring force directed radially inwardly. It is to be noted that inner surfaces 47 of the tops of segments 43 are tapered whereby an axial force exerted on them by the cartridge components causes them to move outwardly against the slight hoop tension created when cam surface 35 of cap 33 abuts inner surfaces 47. The tapering of inner surfaces 47, therefore, provide means for moving segments 43 radially outward.

After carrier tube 10 has been emptied, another cartridge may next be inserted into the top of carrier tube 10 through cap opening 34, the nose of the bullet wedging segments 43 apart as it passes therethrough. Cap 33 is then tightened until cam surface 35 contacts outer surfaces 48 of segments 43, thereby, closing segments 43 about the cannelure. The inertial bullet puller of the present invention is, thus, ready for removal of the bullet from the new cartridge.

It should be apparent to one skilled in the art that the objects of the invention have been realized in the bullet puller embodying the present invention. The annular segmented support is adaptable to a larger range of cannelure diameters and engages the cannelure over a major portion of the circumference thereof. The cap need not be removed between each use of the device and is easily rotated the slight amount needed to tighten and free the annular segmented support.

Figure 7:
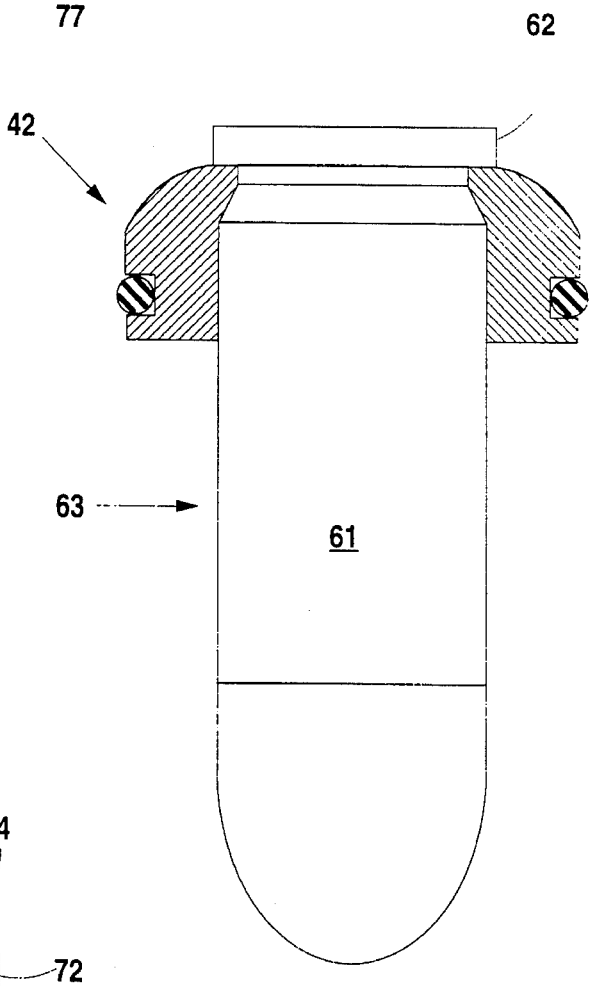
FIG. 7 is a side view in partial cross section showing the first or third embodiment of the annular segmented support of the present invention engaging a cartridge.

Referring now to FIG. 7, there is shown how annular segmented support 42 can engage the sides of case 61 beneath rim 62 of rimmed cartridge 63. The inertial bullet puller of the present invention is, therefore, suitable for use with all types of cartridge cases e.g., rimmed, semi-rimmed, rimless, rebated, and belted. In each case, annular segmented support 42 is engageable with the sides of the case adjacent the flange at the primer end of the case formed by the rim or the side of the cannelure. Although annular segmented support 42 preferably snugly engages the sides of the case when the cap is screwed down, the important point is that the segments lie underneath, i.e., overlap, the flange to transmit force thereto when the puller is used. Although engagement of the segments with the sides of the case is not essential, it is especially desirable in the situation of a rimmed case in order to prevent the cartridge from accidentally coming out of the puller through the opening 34 in cap 33. Engagement with the sides of the case sufficient to hold the cartridge independently of the flange without marring the case would be possible, however, if the segments engage the case over a sufficiently large area and the case is tapered. In the latter case the inner edges of the segments preferably would be tapered correlative to the cartridge taper and relieved at their upper ends to prevent marring the case. The surfaces of the segments that engage the case are preferably smooth but could be serrated or roughened if it is desired to engage the case more positively.

From the foregoing description and illustration of the present invention, it should be apparent that various modifications can be made by reconfigurations or combinations to produce similar results. It is, therefore, the desire of the applicant not to be bound by the description of the present invention contained in this specification, but to be bound only by the claims as appended hereto.

I claim:

1. A bullet puller comprising:

a carrier having an opening at its upper end adapted to receive a cartridge and a head at its lower end adapted to be struck against a hard surface;

an annular segmented support disposed about said upper end of said carrier for engaging the cartridge;

said annular segmented support comprising a plurality of adjacent segments flexibly connected together wherein said flexible connection maintains said plurality of segments in an expanded position but still permits the radially inward movement of said plurality of segments to a contracted position;

means movably mounted over said opening at said upper end of said carrier for forcing said plurality of segments radially inward; and a handle connected at one end to said carrier for imparting motion to said carrier to strike it against said hard surface.

2. The bullet puller according to claim 1 wherein said plurality of segments are connected together utilizing an oversized O-ring mounted within outer peripheral grooves formed in said segments.

3. The bullet puller according to claim 1 wherein said plurality of segments are provided with tapered surfaces along their inner peripheries to permit the movement of said segments radially outward.

4. The bullet puller according to claim 1 wherein said means movably mounted over said opening comprises a cap which engages threads on said upper end of said carrier, said cap having a cam surface on its interior adapted to engage said plurality of segments.

5. The bullet puller according to claim 4 wherein said cap further provides means for retaining said plurality of segments on said upper end of said carrier.

6. The bullet puller according to claim 1 wherein said carrier is a tube closed at its lower end.

7. The bullet puller according to claim 1 wherein said handle comprises a metal shaft having a fluted handgrip mounted on the end opposite from said carrier.

8. The bullet puller according to claim 1 wherein said carrier tube comprises a rigid, tough plastics material capable of propagating an elastic shock wave therein at a speed on the order of at least 6000 ft./sec.

9. The bullet puller according to claim 1 wherein said handle connects at one end of said carrier at an angle not perpendicular to the axis of said carrier, wherein said non-perpendicular angle facilitates the striking of said head means squarely against said hard surface.

* * * * *